United States Patent [19]

Seymour

[11] Patent Number: 5,048,723

[45] Date of Patent: Sep. 17, 1991

[54] BOTTLED WATER OPENER AND FLOW CONTROLLER

[76] Inventor: Charles M. Seymour, 6309 Sylvan Dr., Simi Valley, Calif. 93063

[21] Appl. No.: 873,500

[22] Filed: Jun. 12, 1986

Related U.S. Application Data

[63] Continuation-in-part of Ser. No. 567,042, Dec. 30, 1983, abandoned.

[51] Int. Cl.[5] ..... B67D 3/00

[52] U.S. Cl. ..... 222/81; 222/88; 222/90; 222/478; 222/547; 222/564; 141/322; 141/330

[58] Field of Search ..... 222/81, 88, 83, 83.5, 222/564, 547, 566, 567, 478, 89, 90; 141/329, 330, 322, 321, 320, 319; 137/797; 251/149.1, 127

[56] References Cited

U.S. PATENT DOCUMENTS

| | | | |
|---|---|---|---|
| 1,044,560 | 11/1912 | Morgan et al. | 222/90 |
| 1,248,705 | 12/1917 | Pogue | 222/83.5 X |
| 1,405,638 | 2/1922 | Strongson | 222/90 |
| 1,971,284 | 8/1934 | Stockman | 222/478 X |
| 2,311,763 | 2/1943 | Lanfare | 222/478 |
| 2,714,977 | 8/1955 | Davis | 222/478 X |
| 3,043,316 | 7/1962 | Bolser | 222/564 X |
| 3,102,651 | 9/1963 | Boese | 222/421 X |
| 3,184,107 | 5/1965 | Kohanzo | 222/90 X |
| 3,580,423 | 5/1971 | Gilman | 222/90 X |
| 4,050,611 | 9/1977 | Frantz | 222/478 X |
| 4,267,945 | 5/1981 | Maynard, Jr. | 222/83.5 |

FOREIGN PATENT DOCUMENTS

| | | | |
|---|---|---|---|
| 1574140 | 7/1969 | France | 222/564 |

*Primary Examiner*—David H. Bollinger

[57] ABSTRACT

A bottled water plastic cap opener and flow controller assembly includes a three-part unit forming a hollow housing which has a generally circular cross section and is slightly tapered from end to end. The larger end of the housing is open and has a diameter sufficient to receive the end of a five-gallon water bottle provided with a plastic "tear-away" cap. The smaller end of the housing is closed except for a central opening. A transverse partition extends across the housing about half way between the two ends thereof, and is provided with a large central opening, and at least one additional smaller drainage opening. A piercing member is mounted on the central partition enclosing the central opening and extends upwardly toward the larger open end of the housing but not beyond its edge, to pierce a hole in the plastic cap when the assembly is firmly pushed down on the top of one of the five gallon water bottles. Outwardly extending protrusions or nipples from the piercing member hold the assembly to the plastic cap and facilitate drainage. Between the central partition and the smaller end of the assembly is a flow restrictor arrangement which provides adequate time to raise the bottle and put it onto a cooling stand in accordance with normal practice, but without the problem of unrestricted water flow with a consequent splashing which is often encountered when the 5-gallon bottles are mounted onto the cooling stands. The flow restrictor may be made of several discs which are provided with small openings to permit a convoluted flow path for the water. The axial length of the flow restrictor is less than its diameter.

10 Claims, 2 Drawing Sheets

BOTTLED WATER OPENER AND FLOW CONTROLLER

RELATED PATENT APPLICATIONS

This is a continuation-in-part of U.S. Pat. application Ser. No. 567,042, filed Dec. 30, 1983, now abandoned.

FIELD OF THE INVENTION

This invention relates to bottle opening and liquid flow restricting apparatus.

BACKGROUND OF THE INVENTION

It has been common up to the present time to encounter water spillage, splashing, and other problems when a new 5-gallon water bottle is placed on a cooling stand. This problem arises from the weight of a full 5-gallon water bottle, which can weigh about 40 pounds, and from the fact that the bottles have a fairly large mouth, in the order of 1½ inches in diameter, so that as the bottle is turned over, spillage and splashing of the water may easily occur. Further, this is particularly true, in the case of persons with limited strength and coordination, for whom the handling and mounting of the heavy water bottle on a cooler is difficult.

Accordingly, a principal object of the present invention is to improve and simplify arrangements for opening and controlling the flow of water from conventional plastic capped 5-gallon water bottles.

SUMMARY OF THE INVENTION

In accordance with a preferred embodiment of the present invention, a housing having a generally circular cross-sectional configuration, is open at one end, and is closed at the other end, with the exception of a central aperture. A partition extends transversely across the housing between its ends, and this partition is also provided with a central opening. Extending toward the open end of the housing and mounted on the partition, around the opening through the partition is a piercing member. This piercing member extends upwardly toward the open end of housing but not beyond the edges thereof. Between the central partition and the closed end of the housing is a flow restrictor, to slow the passage of water through the housing.

In accordance with a further aspect of the invention, the housing may be formed in three plastic injection molded parts, with the partition and the upper open portion of the housing in one part, the partially closed end and another section of the outer wall of the housing in a second part, and a third part including the flow restrictor elements.

In one embodiment of the invention, extending along the inner surface of the open end of the housing in to the piercing element may be an air passageway or groove, to provide pressure relief as water is drawn from the bottle, and to permit air to enter the bottle to relieve the pressure. In addition, one or more small secondary holes may be provided through the partition adjacent the piercing element to avoid the possibility that water could be entrapped in the housing, and subsequently spilled. In addition, the flow restrictor may conveniently be formed of a series of discs, one overlying the other, and with peripheral cuts on opposite sides thereof so that water must flow back and forth from one side of the housing to the other in order to pass through the housing. The housing is also preferably slightly tapered from the larger open end to the smaller closed end, to facilitate the plastic molding of the assembly and to hold the water bottle firmly after the piercing operation has been completed.

In accordance with a broad aspect of the invention, a bottle opener and flow controller assembly includes a piercing member for forming a hole in a plastic cap for a five gallon water bottle, arrangements for holding the assembly onto the water bottle, and a flow restrictor for delaying the flow of water through the assembly.

In accordance with another embodiment of the invention, the piercing element may be provided with a plurality of outwardly extending bumps or nipples to provide a slight additional enlargement at points around the main opening through the plastic cap, for water drainage, and to hold the housing onto the plastic cap after piercing has been accomplished. In this regard, it may be noted that the piercing member has a transverse cutting configuration which stops above the level of the transverse partition, to hold the flexible plastic flap cut from the cap, up so that it will not impede water flow. In the absence of special drainage arrangements a quantity of water would be trapped and be spilled as the housing is removed from the empty bottle. With the slight enlargement of the pierced hole by the protrusions and two small holes through the partition adjacent the piercing element, this drainage problem is fully solved.

It is also noted that the housing is relatively short in its over-all configuration, so that it will readily fit into normal water coolers. More specifically, the flow restrictor portion, by which the effective length of the bottle is extended, has an axial extent which is even less than its diameter.

The invention has a number of advantages including the convenience of both piercing the plastic cap and also restricting the flow of water by a single device. In addition, the plastic caps are automatically returned to the bottled water company in large quantities, where they may be easily and conveniently recycled. Another advantage of the assembly is the convenience in disassembly and cleaning of the unit.

Other objects, features, and advantages of the invention will become apparent from a consideration of the following detailed description and from the accompanying drawings.

DETAILED DESCRIPTION

Figure 1:
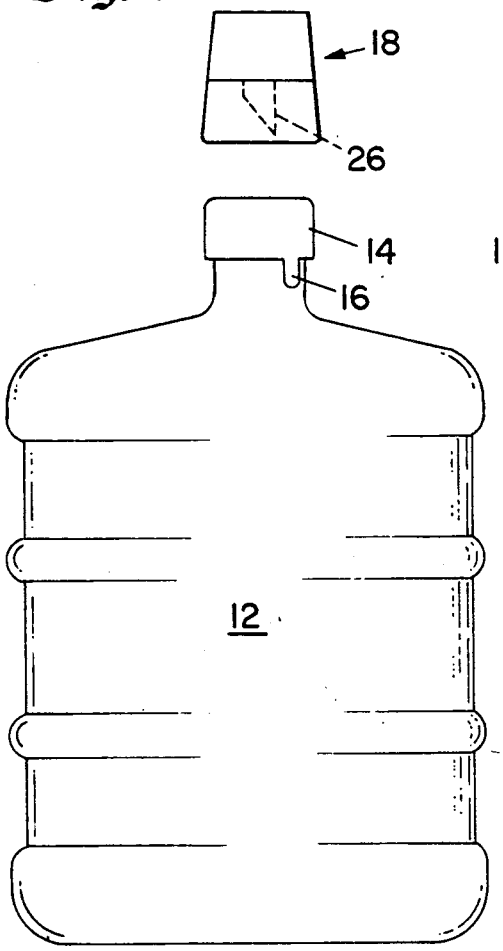
FIG. 1 shows a 5-gallon water bottle provided with a plastic cap and a unit illustrating the principles of the invention in position to pierce the plastic cap of the bottle.

Referring more particularly to the drawings, FIG. 1 shows a 5-gallon plastic water bottle 12 of the type which is intended for use with a water cooler. The bottle 12, when filled, weighs about 40 pounds. The plastic cap 14 is sealed in place and is provided with a pull tab 16 by which the cap 14 may be stripped off prior to inverting the bottle 12 and mounting it on the usual water cooler. As shown in FIG. 1, above the cap 14 is an opener and flow restrictor assembly 18 illustrating the principles of the present invention.

Figure 2:
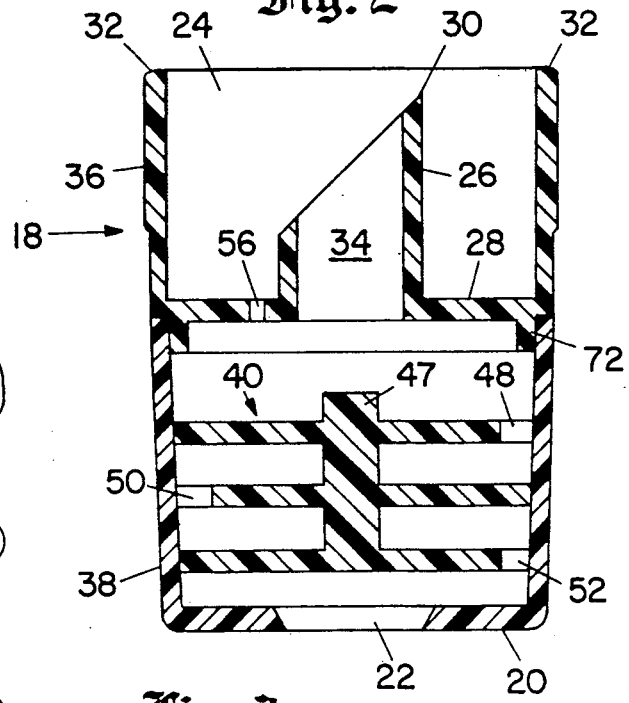
FIG. 2 is a cross-sectional view of a bottle cap opener and flow controller assembly illustrating the principles of the present invention.

The bottle opener and flow controller 18 is shown to an enlarged scale and in a cross-sectional view in FIG. 2. Unit 18 is tapered slightly from its smaller end 20 which is provided with a central opening 22, to its larger open end 24 into which the piercing member 26 is recessed and mounted on an intermediate wall 28. The piercing member 26 is shown in dashed lines in FIG. 1 to indicate that the piercing member is oriented as shown in FIG. 1 during the preliminary step when the plastic cap 14 is being pierced by member 26.

In the preferred construction, the piercing member 26 may be circular at its base, and is cut at an angle so that it has a sharp cutting edge 30 which is recessed slightly below the lip 32 at the open end 24 of the assembly 18. A central opening 34 extends through the piercing element 26 and the medial wall 28 of the assembly.

The assembly 18 is formed of three parts, the enlarged and open upper portion 36 including the piercing member 16, the smaller lower portion 38 which includes the lower end wall 20 having the central opening 22, and a removable flow restrictor section 40 which is contained within the lower portion 38 of the housing assembly, as shown in FIG. 2.

Figure 3:
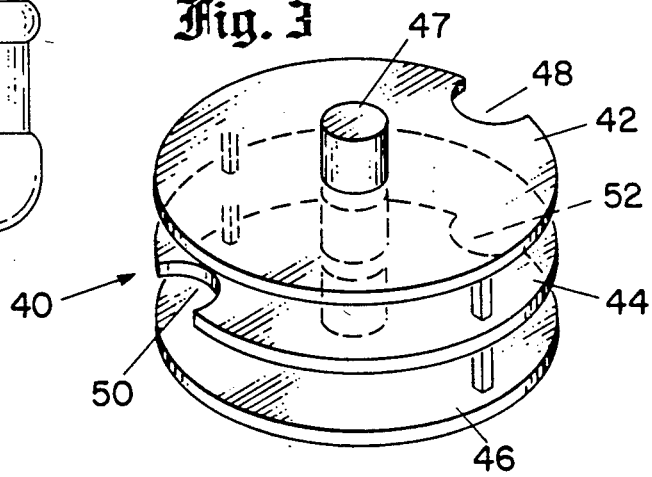
FIG. 3 shows the flow restrictor discs separate from the remainder of the assembly of FIG. 2.

As mentioned above, one of the problems of mounting a water bottle onto a cooler, with the need to turn the bottle upside down, is the problem of spilling or splashing water in the course of this operation. One of the features of the present invention involves the avoidance of the problem by the use of the flow restrictor assembly 40, as shown in cross section in FIG. 2, and in an isometric view in FIG. 3. More specifically, as shown in FIG. 3, the flow restrictor 40 is a plastic injection subassembly which includes three discs 42, 44 and 46 which are slightly tapered in their overall peripheral configuration to make a relatively tight fit with the inner wall of the lower assembly 38. A small protruberance or button 47 is provided to assist in the separation of the assembly 40 from the lower portion 38 of the housing. The three discs 42, 44 and 46 are each provided with one peripheral cut-out 48, 50 and 52, respectively. These cut-outs force the water to follow a circuitous path from the opening 34 to the cut-out 48, then to the cut-out 50 on the diametrically opposed side of the assembly, then to the cut-out 52 back on the other side of the unit and finally to the exit opening 22. This circuitous path slows down the flow of water so that a person seeking to invert the bottle of water and place it on the water cooler has plenty of time to do so, in the order of about two seconds, and is not troubled with the possibility of water spilling or splashing.

Figure 4:
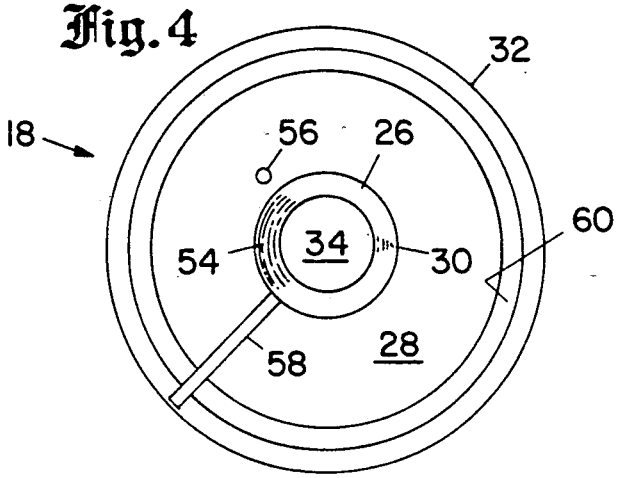
FIG. 4 is a view of the assembly from the larger open end thereof.

FIG. 4 is a view of the assembly of FIG. 2 taken from the open end 24. In the view of FIG. 4, the high point 30 of the piercing element 26 is at the right-hand side and the low point 54 of the element is at the left-hand side. In practice, when the piercing member 26 is inserted through the plastic cap 14, a flap will remain, and this will be located adjacent the low point 54 of the piercing element 26. Because a small amount of water might otherwise collect between the cap and the wall 28, and in the cap below the level of point 54, a small opening 56 is provided to permit this water to drain on into the water cooler, as the bottles empties. Also shown in FIG. 4 is a small groove 58 which extends down the tapered inner surface 60 of the open sidewall of the assembly, and across the medial wall 28 to the piercing element 26. This groove 58 permits the passage of air into the water bottle 12 as water flows out of it, when it is in position upside down on a water cooler. It may be noted in passing that the opening 56 and the groove 58 are displaced about the axis of the assembly 18 with respect to the low point 54 and the high point 30 of the piercing element 26 as shown in FIG. 4, and their showings in FIGS. 2 and 5, are not strictly accurate, but they have been selectively included in these figures of the drawings to more clearly disclose the mode of operation of the present unit.

Figure 5:
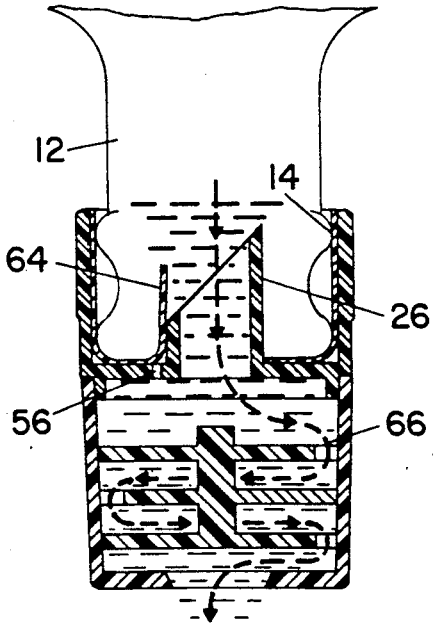
FIG. 5 is a cross-sectional view similar to that of FIG. 2, but showing the unit assembled with the top of a water bottle, as it would be in use.

FIG. 5 is a showing somewhat similar to that of FIG. 2, but with the water bottle 12 and the plastic cap 14 in place, as the unit would appear when mounted in a water cooler. The showing of FIG. 5 indicates the approximate position of the flap 64 which is cut out of the plastic cap 14, as the piercing element 26 is inserted through the cap. Although the circuitous path of the water has been generally mentioned above, in FIG. 5, the dashed line 66 interspersed with arrows is included to show the complete path.

An alternative embodiment of the invention will now be described in connection with FIGS. 6, 7, and 8 of the drawings. In these figures of the drawings the same reference numerals will be used for parts which are the same as in the embodiment of FIGS. 1-5.

Figure 6:
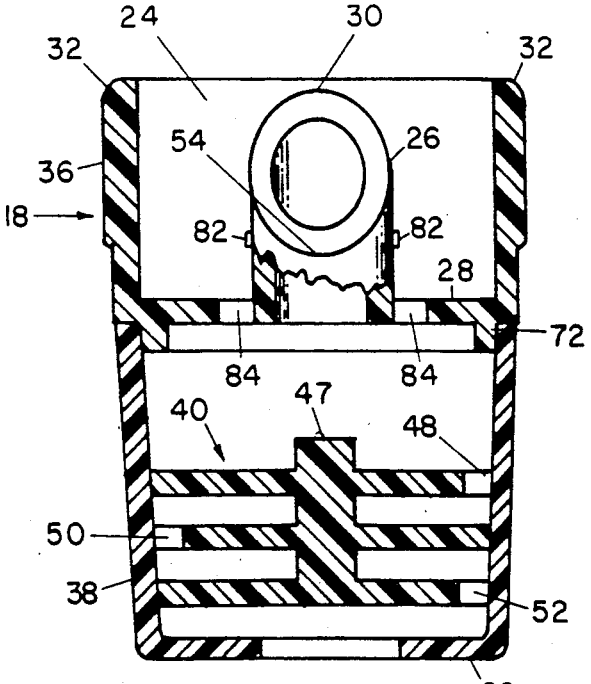
FIG. 6 is a transverse partial cross-sectional view of an alternative embodiment of the invention.

The principal differences in the alternative embodiment of FIG. 6 are the provision of a pair of nipples or protrusions 82 which extend outwardly from the piercing member 26, and the provision of a pair of openings 84 immediately below the nipples 82. As the plastic cap is pierced, the nipples 82 make slight additional indentations in the pierced hole, to permit trapped water to escape and drain through the holes 84. Otherwise, as mentioned above, because of the height of low point 54 of the piercing opening above the partition 28, water would stay trapped and might spill when the housing is removed from the (substantially) empty bottle.

Figure 7:
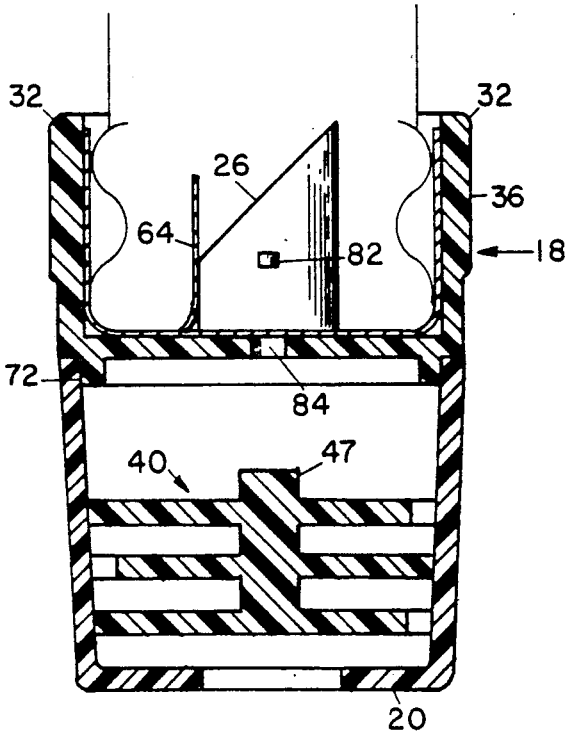
FIG. 7 is another partial cross-sectional view showing a bottle in place after having been pierced.

FIG. 7 is a slightly different view of the arrangement of FIG. 6, with the cap 14 being pierced, and being held in place by the outwardly extending nipples 82.

Figure 8:
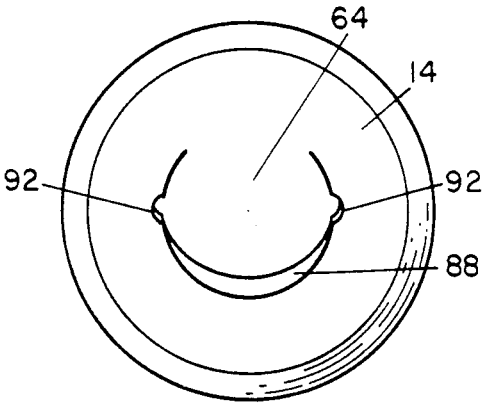
FIG. 8 is an end view of a plastic cap following piercing.

FIG. 8 is an end view of one of the plastic caps which has been pierced but removed from the housing. Once the cap has been removed from the piercing member 26 of the housing, the flap 64 tends to flop back toward the opening 88. In view of this flexility of the plastic cap, the piercing member 26 must extend a short distance such as ⅜ inch above partition 28 to maintain the flap in its upward orientation, and so that it will not close the central opening.

In FIG. 8 the two small additional indentations 92 in the periphery of the pierced hole 88 may be noted. These additional points of enlargement permit drainage of the entrapped water, through openings 84 in partition 28.

Now that the overall mode of operation of the device has been described, certain particular features will be noted. The arrangement of the unit in three parts which fit snugly together for assembly, permits easy cleaning of the units prior to initial installation or in the event that they should be soiled. The fact that the piercing tube is recessed into the open end of the assembly, and is not exposed, prevents inadvertent injury to users who might otherwise press against the piercing element. One minor advantage of the present system is that the plastic caps are automatically returned to the bottled water company for recycling.

With regard to the construction of the unit, it may be made of any suitable high strength plastic which is capable of maintaining a reasonably sharp piercing edge. Initial units have been made of injection molded polyvinyl chloride plastic but other materials, either plastic or metal, could, of course, be employed. The units weigh between three and three and-one-half ounces. The assemblies have a height of approximately 3⅜ths inches and taper from approximately 2⅝ths inches to 2 7/16ths inches from the larger open end to the smaller end. The wall thickness of the housing is approximately ⅛th inch. The lower portion 38 of the assembly makes a firm press fit onto the upper portion where they overlay at area 72 as shown in FIGS. 2 and 5; but thread or other locking arrangements may be provided as an alternative. The axial length of the delay portion 38 of the assembly is approximately one and thirteen-sixteenths inches, and is thus less than its diameter, so that there is little additional effective extension of the axial length of the water bottle which might interfere with or impinge upon the internal parts of the water cooler.

For completeness, reference is made to U.S. Pat. No. 4,267,945, granted May 19, 1981 to W. P. Maynard, Jr., for a "Liquid Funnel and Container Piercing Blade Combination", and to French Patent No. 1,574,140 published July 11, 1969, inventor: Bruno Morane. The U.S. patent includes arrangements for piercing an oil can, by a separate metallic piercing element, but includes no arrangements for delaying the flow of oil, and includes a long pouring spout. In passing, it is noted that it is normally desirable to speed up the dispensing of oil when oil is being added to an automobile engine or the like, rather than to slow it down. Concerning the French patent, it includes a long spout and a number of disks of successively reduced diameter fitting into the long spout, with the arrangements being intended to mix two fluids under pressure, to form a gel. The intended use of the French patented device is not clear, but from its configuration it would appear possible that the gel which is formed could be intended for feminine hygiene purposes. There is no indication in the French patent of any intent to delay the flow of liquid, nor is there any piercing member included in the French patent. The foregoing two patents were cited in the course of the prosecution of the parent patent application, and are therefore made of record in this specification.

The three plates within the delay section are between two and two and one-quarter inches in diameter, and are spaced apart by about 5/16 inch, preferably between 3/16 inch and ⅜ inch apart. With these dimensions the initial delay in flow is approximately two seconds, and there is no delay in receiving water from the water cooler later.

To supplement the foregoing detailed description, and to provide additional insights into the invention, certain additional points will now be brought out, in briefly reviewing the mode of operation of the unit and certain collateral matters. First, the piercing member 26 makes a hole in the plastic cap 14, and water flows through the inner diameter or opening 34 of the piercing member 26. The nipples or protrusions 82 as shown in FIGS. 6 and 7, on the piercing member 26 prevent the assembly 18 of the present invention from falling off of the plastic cap 14 and permit the use of the assembly 18 with bottles having smaller caps 14 which have no engagement between the outer periphery of the cap and the inner wall of the open end 24 of the assembly 18. It may also be noted that the use of the nipples or protrusions 82 to hold the unit 18 in place permits the use of a unit having a substantially greater inner diameter, which does not make a precise fit with the cap, so that the unit 18 becomes more universal in application. The function of the piercing member 26 in holding the flap 64 up, and the function of the slight enlargements 92 in permitting the final draining of water through holes 84, have been noted hereinabove. By the use of two or more protrusions 82 and holes 84, substantially complete drainage is assured despite tipping of the water bottle 12 and assembly 18 in one direction or the other. It is also noted that the additional recesses 92 formed by the protrusions or nipples 82 do not have as great a radial extent as the protrusions, but are merely slight indentations permitting water drainage, with the cap engaging the protrusions 82 if the assembly 18 starts to slip off the cap 14.

It is further noted that the larger open end 24 of assembly 18 may serve both as a water reservoir and as an air vent, particularly when the bottle cap 14 is of lesser diameter than the open end 24. Concerning the reservoir function of the open end, when the bottle is first turned over, it fills nearly to the top with water as the unit is being turned over and set into place, and thus is part of the mode of operation of the unit. The lower portion 38 also constitutes a water reservoir; and the flow of water around the three intermediate baffles, and then through lower baffle constituting the bottom of the assembly 18, in filling up this lower reservoir, provides the two second delay which is just adequate for mounting the water bottle in place on the water cooler stand. Incidentally, in tests made by the inventor it was found that with a full five gallon bottle, the two second delay was obtained; however, when a five gallon bottle having only four gallons of water in it, is inverted from an upright position, there is virtually no delay. Also, when the inventor attempted an alternate design with four baffles located in the space of the three baffles of FIG. 2, using the same thickness of baffles but with reduced space between them, the delay was so prolonged as to be unacceptable for water cooler usage.

A further advantage of the present invention is the reduction in noise achieved by the assembly, reducing the "glug, glug, glug" sound now heard when water coolers are used. The central location of the piercing member 26 and the lower water output opening are also noted. With these centrally located input and output openings, there is no adverse effect on the coaxial seal of the bottle with the water cooler, in contrast to the peripheral positioning of the oil can piercing arrangements of the Maynard patent, for example. It is also noted that the water cooler application where the lower end of the five-gallon water bottle, or the assembly 18, is at the water level in the cooler, is entirely different from the mode of operation of an oil can dispensing funnel. Thus, in the water cooler application, the flow from the bottle stops when the water level in the cooler rises to the level of the lower end of the bottle, or the assembly 18. On the other hand, the lower end of the pouring spout of an oil can funnel such as that shown in the Maynard patent, is always above the oil level in the engine, so the oil flows rapidly and completely from the oil can into the engine. Thus, applicants were faced with a different problem, and their compact, short length flow restrictor is compatible with, and does not interfere with the intermittent flow, leveldependent mode of operation of the water cooler system. It is also noted that water flow through the flow restrictor when it is mounted on the bottle does not interfere with the automatic level regulating mode of operation of the water cooler.

In conclusion, it is to be understood that the foregoing description relates to one specific preferred illustrative embodiment of the invention. Various changes could be made without departing from the spirit and scope of the invention. Thus, by way of example and not of limitation, the assembly may be made with an alternative type of piercing element, and with several smaller holes instead of the one large hole 34 which is used in the disclosed embodiment. In addition, the flow restricting element could have a different configuration, and the central medial wall could be formed as part of the lower assembly, with the lower wall 20 being part of the flow restrictor assembly. Accordingly, the present invention is not limited to that precisely as shown in the drawings and described in the foregoing detailed description.

What is claimed is:

1. A bottled water plastic cap opener and flow controller assembly comprising:

a hollow housing substantially open at a first end thereof, and closed with the exception of at least one opening at its other end;

said housing having a transverse medial partition with at least one opening therethrough;

a sharp piercing member mounted on said medial partition adjacent said opening, said piercing member extending axially toward said first end of said housing but terminating inwardly from the end thereof;

said piercing member, said medial partition, and the open end of said housing, being formed of a single plastic injection moulded part;

flow restrictor means located within said housing between said partition and the other end thereof, said flow restrictor having an axial extent which is less than the diameter thereof;

whereby a five gallon plastic water bottle sealed with a plastic end cap may be opened by pressing the piercing member of said assembly down onto the plastic end cap to form a central hole therein, and the flow restrictor means allows a substantial time period for turning the bottle over and setting it onto a water cooler stand and said piercing member being molded integrally with said medial partition and having a plurality of outwardly extending protrusion means on the outer surface thereon to hold a plastic cap onto said piercing member, and wherein said medial partition has at least one additional small hole through it adjacent said piercing member to facilitate draining of water.

2. A bottle opener and flow controller assembly as defined in claim 1 wherein said flow restrictor means includes a plurality of plates with edge notches on opposite sides of successive plates.

3. A bottled water plastic cap opener and flow controller assembly as defined in claim 1 wherein said piercing member is hollow tube of plastic cut across at an angle, with the lower edge of the cut terminating at a point spaced away from said medial partition to prevent blockage of said opening by a flap cut into the plastic cap.

4. A bottled water plastic cap owner and flow controller assembly comprising:

a hollow housing substantially open at a first end thereof, and closed with the exception of at least one opening at its other end;

said housing having a transverse medial partition with at least one opening therethrough;

a sharp piercing member mounted on said medial partition and enclosing said opening, said piercing member extending axially toward said first end of said housing but terminating inwardly from the end thereof;

flow restrictor means located within said housing between said partition and the other end thereof;

said assembly being made of three parts: (a) a first one of said parts being generally cup-shaped and including the medial partition, the piercing member mounted thereon, and the exterior wall of the housing from the open end to the medial partition; (b) the second part also being generally cup-shaped and including the remainder of the exterior wall of the housing from the smaller end of the assembly up to the medial wall, and including means for making a tight securing fit with said first part; and (c) a flow restrictor assembly including a plurality of plates for mounting within said second part;

each of the three parts as enumerated above being formed of a single plastic injection molded part;

said housing having sides which extend substantially straight or slightly tapered from one end to the other end, and said housing having an overall longitudinal extent which is less than twice its transverse extend;

the axial extent of said flow restrictor assembly being less than its transverse extent;

whereby a five gallon plastic water bottle sealed with a plastic end cap may be opened by pressing the piercing member of said assembly down onto the plastic end cap to form a central hole therein, and the flow restrictor means allows a substantial time period for turning the bottle over and setting it onto a water cooler stand; and said piercing member being molded integrally with said medial partition and having a plurality of outwardly extending protrusion means on the outer surface thereon to hold a plastic cup onto said piercing member, and wherein said medial partition has at least one additional small hole through it adjacent said piercing member to facilitate drainage of water.

5. A bottle opener and flow controller assembly as defined in claim 4 further including a groove extending down the inner surface of said assembly from the open end thereof to the piercing member, to permit the flow of air.

6. A bottled water plastic cap opener and flow controller assembly as defined in claim 4 wherein said second part including said flow restrictor means includes three plates each of which is between two and two and one-quarter inches in diameter and spaced apart by between 3/16 and ⅜ of an inch.

7. A bottled water plastic cap opener and flow controller assembly as defined in claim 4 wherein said piercing members have a plurality of outwardly extending protrusion means on the outer surface thereon to hold the plastic cap onto said piercing member, and wherein said medial partition has at least one additional small hole through it adjacent said piercing member to facilitate drainage of water.

8. A bottled water plastic cap opener and flow controller assembly as defined in claim 4 further including means for holding said housing onto a plastic cap, and means for draining said housing when the bottle of water is empty.

9. A bottled water plastic cap opener and flow controller assembly as defined in claim 8 wherein said piercing member is a hollow tube of plastic cut across at an angle, with the lower edge of the cut terminating at a point spaced away from said medial partition to prevent blockage of said opening by a flap cut into a plastic cap.

10. A bottled water plastic cap opener and flow controller assembly comprising:

a hollow housing having a circular cross-sectional configuration, said housing being tapered from a smaller end to a larger end, said housing being substantially open at its larger end, and closed with the exception of a central opening at its smaller end;

said housing having a transverse medial partition with a central opening wherein said medial partition is formed as an integral part of said housing;

said housing having a slightly tapered configuration between said larger top end surface thereof and said medial partition;

a sharp piercing member mounted on said medial partition and enclosing said opening, said piercing member extending axially toward the larger end of said housing but terminating inwardly from the end thereof;

flow restrictor means located within said housing between said partition and the smaller end thereof, said flow restrictor having an axial extend which is less than the diameter thereof;

a plurality of outwardly protruding nipple means on the outer surface of said piercing member intermediate the ends thereof to hold the assembly onto a plastic cap of a bottle of water and to form small drainage recesses in the plastic cap;

said medial partition having at least one small opening adjacent but exterior to said piercing member for draining water from said housing;

whereby a five gallon plastic water bottle sealed with a plastic end cap may be opened by pressing the piercing member of said assembly down onto the plastic end cap to form a central hole therein, and the flow restrictor means allows a substantial time period for turning the bottle over and setting it onto a water cooler stand;

said assembly being made of three parts:

(1) a first one of said parts being generally cup-shaped and including the medial partition, the piercing member mounted thereon, and the exterior wall of the housing from the open end to the medial partition, (2) the second part also being generally cup-shaped and including the remainder of the exterior wall of the housing from the smaller end of the assembly up to the medial wall, and including means for making a tight securing peripheral fit with said first part; and (3) said flow restrictor means including a plurality of plates for mounting within said second part;

said first part including said piercing member being formed of a single plastic injection molded part;

said flow restrictor means including a plurality of circular plates with peripheral notches on opposite sides thereof; and said second part including said flow restrictor means including three plates each of which is between two and two and one-quarter inches in diameter and spaced apart by between 3/16 and ⅜ of an inch.

* * * * *